United States Patent [19]

Spademan

[11] 4,360,219

[45] Nov. 23, 1982

[54] SKI RELEASE BINDING WITH REARWARDLY MOVABLE CLAMPING MEMBER

[76] Inventor: Richard G. Spademan, P.O. Box 6410, Incline Village, Nev. 89450

[21] Appl. No.: 176,012

[22] Filed: Aug. 7, 1980

Related U.S. Application Data

[63] Continuation of Ser. No. 890,574, Mar. 20, 1978.

[51] Int. Cl.[3] ..... A63C 9/08

[52] U.S. Cl. ..... 280/624

[58] Field of Search ..... 280/624, 625

[56] References Cited

U.S. PATENT DOCUMENTS

| | | | |
|---|---|---|---|
| Re. 26,972 | 10/1970 | Spademan | 280/624 |
| 3,606,370 | 9/1971 | Spademan | 280/624 |
| 3,638,959 | 2/1972 | Renge | 280/625 |
| 3,884,492 | 5/1975 | Spademan | 280/624 |
| 4,145,071 | 3/1979 | Salomon | 280/624 |

*Primary Examiner*—Robert R. Song

*Attorney, Agent, or Firm*—Townsend and Townsend

[57] ABSTRACT

A releasable ski binding (1) is provided having a movable clamping member (4,5) for releasably securing a ski boot (10*a*) to a ski (2) rearward of the toe and forward of the rear of the heel of the ski boot (10*a*). In the binding (1), a connecting member (11) is provided which is responsive to a predetermined lateral movement of the movable clamping member (4,5) relative to the ski (2) for allowing the movable clamping member (4,5) to disengage the connecting member (11) and move rearwardly out of the way of lateral movement of the ski boot (10*a*) relative to the ski (2).

12 Claims, 4 Drawing Figures

SKI RELEASE BINDING WITH REARWARDLY MOVABLE CLAMPING MEMBER

RELATED APPLICATION

This is a continuation in part of applicant's application Ser. No. 890,574 filed Mar. 20, 1978.

BACKGROUND OF THE INVENTION

The present invention relates to ski release bindings in general and in particular to ski release side-clamping bindings of the type disclosed and described in applicant's U.S. Pat. Nos. Re. 26,972 and 3,606,370.

Referring to U.S. Pat. No. Re. 26,972 and in particular to the embodiments disclosed and described with respect to FIGS. 7–10 and 17–21, there is provided respectively a pair of jaw members 240 and 540. In U.S. Pat. 3,606,370 there is provided a pair of jaw members 6. In each of the embodiments of the prior patents the jaw members 240, 540 and 6 are coupled to a force unit for providing a clamping force for clamping a ski boot to a ski between the jaw members. In U.S. Pat. No. Re. 26,972, the clamping force unit is designated generally as 16 and in U.S. Pat. No. 3,606,370 the clamping force unit is designated generally as 7.

In the particular embodiments described above, the jaw members 240, 340 and 6, in a releasing condition, and in particular during a rotational release, are caused to move outwardly relative to a housing in which they are movably mounted so that the jaw members become disengaged from the ski boot or a clamping plate attached to the boot. In no case, however, does either of the jaw members in any pair move entirely out of the plane of movement of the ski boot clamped therebetween. To the contrary, the binding is constructed so that jaw movements substantially beyond the point at which the jaws free the boot are prevented so as to avoid a disengagement of the jaws from the internal actuating mechanism of the binding.

During a release involving longitudinal movement of a ski boot relative to a ski or heel lifting movement of a ski boot relative to a ski, the presence of the jaw members 240, 540 and 6 along the sides of the ski boot presents no practical problem by way of an obstruction or impediment to longitudinal movement. During a rotational release, however, the presence of the jaw members 240, 540 and 6 is found to present a potential obstruction with respect to the side of the ski boot during a lateral movement thereof.

In applicant's prior application Ser. No. 890,574, there is disclosed a releasable ski binding comprising at least one movable jaw member and means for releasably clamping a ski boot to a ski with the jaw member rearward of the toe and forward of the rear of the heel of the ski boot. During a release, the movable jaw member is moved. To remove the jaw member as an impediment to lateral movement of the ski boot relative to the ski, as during a rotational or lateral release, means are provided for allowing the jaw member to move in a second direction after the jaw member is moved a predetermined distance in a first direction. In one embodiment, the second direction in which the jaw member moves is below the plane of lateral movement of the ski boot relative to the ski.

In application Ser. No. 890,574, the means for allowing the jaw member described therein to move in a second direction after the jaw member is moved a predetermined distance in a first direction, comprises means for forming the jaw member using separable parts and means for movably coupling the separable parts. The fabrication of separable parts and the assembly thereof is time consuming and costly.

SUMMARY OF THE INVENTION

In a view of the foregoing and in accordance with the present invention, a principal object of the present invention is a ski release binding in which there is provided means for moving a movable clamping member for coupling a ski boot to a ski rearward of the toe and forward of the rear of the heel of the ski boot out of the way of movement of the ski boot during lateral movement thereof relative to a ski during a release.

Specifically, the binding of the present invention has movable clamping members or jaws which have protuberances for engaging the boot, or a clamping plate attached thereto, when the boot is in the binding. The protuberances extend above the sole of the boot and they typically include grooves or the like for engaging the clamping plate. Upon release of the binding, for example, during a fall, the jaws are pivoted laterally outward about vertical posts to disengage the protuberances from the clamping plate. To avoid any interference between the protuberances (of the open jaws) and the boot, and particularly the sole therof, as the boot is freed from the binding, the binding is constructed to disengage the jaws from the internal operating mechanism so as to permit substantially unrestrained pivotal movement of the jaw until the protuberanceis disposed rearwardly of the heel of the boot. At that point the protuberance, though it extends above the sole of the boot, no longer interferes with the free movement of the boot out of the binding and in a plane substantially parallel to the ski.

In accordance with the above object there is provided in an embodiment of the present invention a force unit for providing a clamping force, a connecting member for connecting the clamping force unit to a movable clamping member and means responsive to a predetermined lateral movement of the clamping member for disconnecting the clamping member from the connecting member.

In the embodiment disclosed the connecting member comprises a T-shaped connecting member having a laterally extending member for connecting the movable clamping member and the T-shpaed connecting member. The disconnecting means comprises means for disconnecting the movable connecting member and the laterally extending member when the T-shaped connecting member is moved a predetermined distance longitudinally relative to said movable clamping member.

BRIEF DESCRIPTION OF THE DRAWING

The above and other objects, features and advantages of the present invention will become apparent from the following detailed description of the accompanying drawing in which.

DETAILED DESCRIPTION OF THE DRAWING

Figure 1:
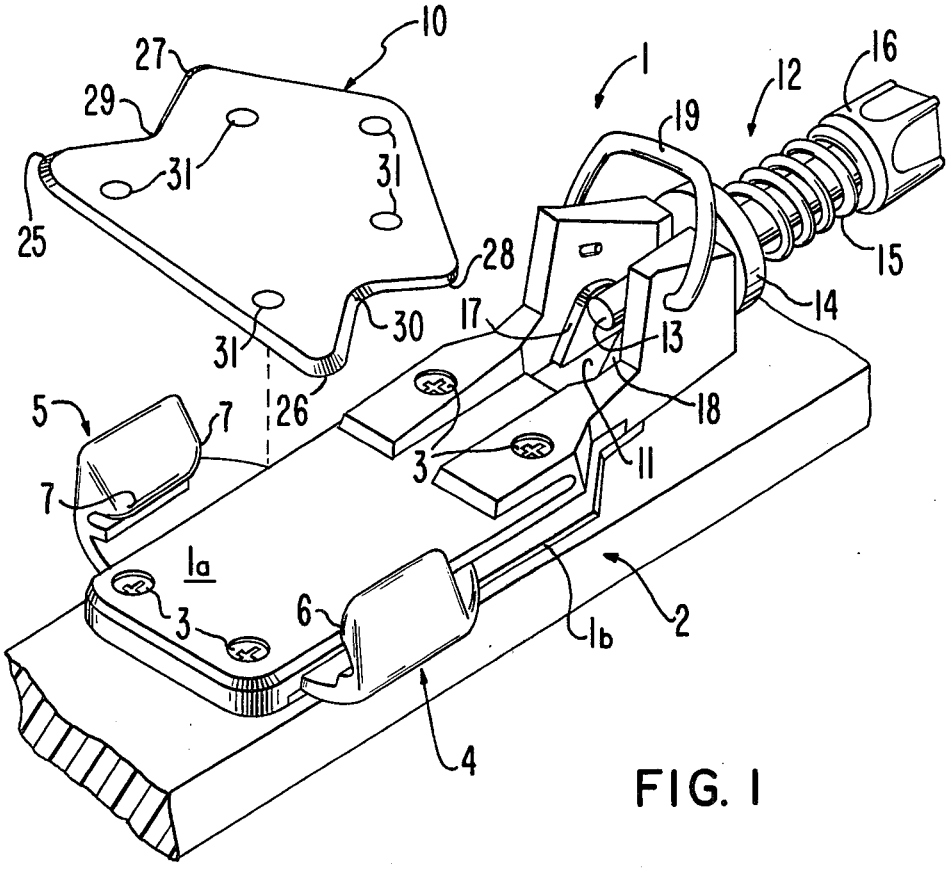
FIG. 1 is an isometric view of a releasable ski binding according to the present invention.
Figure 2:
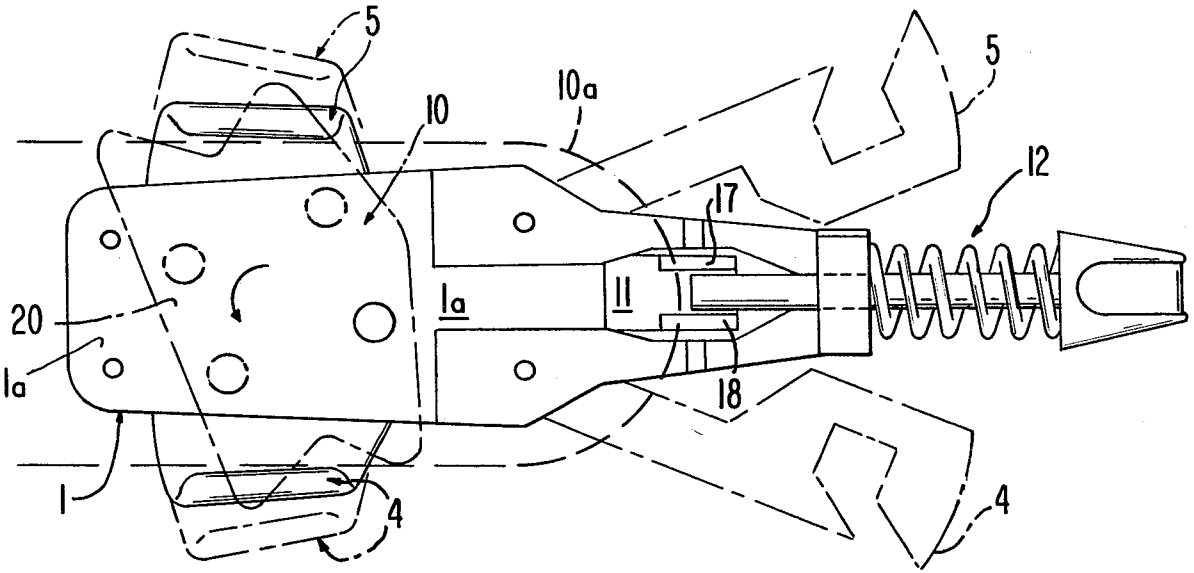
FIG. 2 is a top plan view of FIG. 1.
Figure 3:
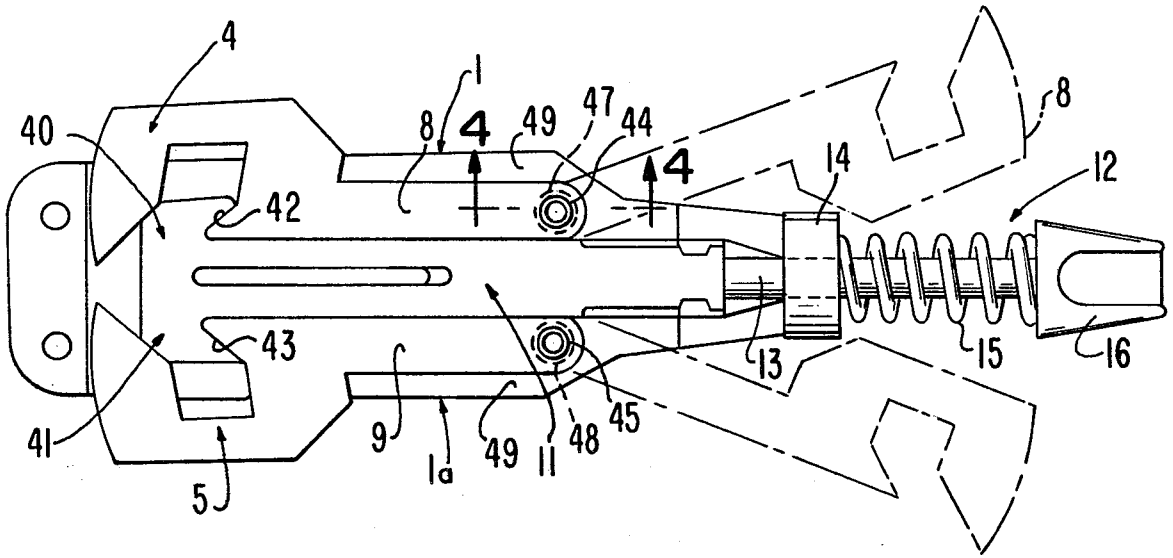
FIG. 3 is a bottom plan view of FIG. 2 with a bottom plate omitted.

Referring to FIGS. 1, 2 and 3, there is provided in accordance with the present invention, a releasable ski binding designated generally as 1 having a housing 1*a* with a bottom plate member 1*b* mounted on a ski 2 as by a plurality of screws 3. In the binding 1 movably mounted between the housing 1*a* and bottom plate 1*b* there is provided a pair of side-clamping members designated generally as 4 and 5. Each of the clamping members 4 and 5 are movably mounted in the binding 1, and provided with facing overhanging protuberances 6 and 7 on the forward ends of a pair of elongated arm members 8 and 9 respectively. The overhanging protuberances 6 and 7 of the jaw members 4 and 5 are provided for engaging a boot mounted plate member designated generally as 10 which is mounted to the sole of a ski boot shown in broken lines in FIG. 2 as 10*a*.

Internally the jaw members 4 and 5 are connected by means of a T-shaped connecting member 11 to a force unit designated generally as 12 which is located at the rear of the binding 1.

In the force unit 12 there is provided a spring rod 13. Concentrically mounted on the spring rod 13 there is provided a spring washer 14, a spring 15 and an adjusting nut 16. The rod 13 is pivotally coupled to the T-shaped connecting member 11 by means of a pair of upstanding members 17 and 18 extending vertically from the connecting member 11. Also provided at the rear of the binding 1 there is provided a bail member 19 for retaining a safety strap, not shown.

In the boot plate 10 there is provided a pair of laterally extending forward tip members 25 and 26 and a pair of laterally extending rearward tip members 27 and 28. The tip members 25 and 27 are connected by an inwardly curved edge 29. The tip members 26 and 28 are connected by an inwardly curved edge 30. A plurality of holes 31 are provided for mounting the plate member 10 to the bottom of the ski boot 10*a*.

As seen in FIG. 3, the T-shaped connecting member 11 is provided with a pair of laterally extending members 40 and 41. For slidably engaging the members 40 and 41 there is provided at the forward end of the arms 8 and 9 of the clamping members 4 and 5, a pair of engaging surfaces 42 and 43 respectively. At their rear ends the arms 8 and 9 of the clamping members 4 and 5 are pivotally connected to the binding 1 by means of a pair of pivot posts 44 and 45.

Figure 4:
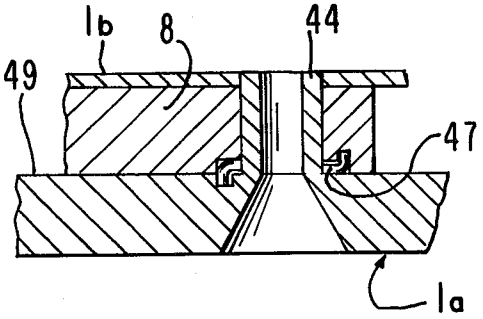
FIG. 4 is a partial cross-sectional view taken along lines 4—4 of FIG. 3.

Referring to FIGS. 3 and 4, the rearward ends of the arms 8 and 9 are attached to one end of a pair of relatively light torsion springs 47 and 48, respectively. The opposite ends of the torsion springs 47 and 48 are attached to an interior wall 49 of the housing 1*a*.

As seen in FIG. 2, during a rotational release of the ski boot 10*a* from the ski 2, the boot mounted plate member 10 rotates between the clamping members 4 and 5 as shown in broken lines. This causes the clamping members 4 and 5 to be moved outwardly, also as shown in broken lines. As the clamping members 4 and 5 are moved outwardly, the T-shaped connecting member 11 is pulled forwardly against the force of the spring 15 in the force unit 12. As the T-shaped connecting member 11 is pulled forwardly, the surfaces 42 and 43 at the forward end of the clamping members 4 and 5 slide outwardly relative to the laterally extending members 40 and 41. After a predetermined lateral movement of the surfaces 42 and 43, the clamping members 4 and 5 become separated from the laterally extending members 40 and 41. When either or both of the clamping members 4 and 5 become separated from the laterally extending members 40 and 41, they are free to pivot rearwardly about the posts 44 and 45 to positions shown in broken lines in FIGS. 2 and 3 against the force of the torsion springs 47 and 48.

In actual use, and after the clamping members 4, 5 have become disengaged from the T-shaped connecting member 11, the boot is freed from the binding. When the boot moves laterally out of the binding and in a plane generally parallel to the ski it, and especially it's sole continues to engage the protuberance 7 of the associated clamping member. At this point no force other than the negligible force from springs 47 or 48 is exerted on the clamping member so that it is free to pivot about the respective pivot post 44 or 45. This pivotal movement of the clamping member continues in a generally rearward direction until the protuberance clears the boot, that is until it is positioned behind the heel of the boot as illustrated in phantom lines in FIGS. 3 and 4. Consequently, the clamping members in general and the portions thereof extending rearwardly above the sole of the boot in the binding no longer "traps" the boot during an emergency release of the binding.

Afterthe boot is clear of the binding, the springs 47 and 48 are free to return the members 4 and 5 and the arms 8 and 9 to their clamping position to be reset.

To reset the binding, the force unit 12 is pivoted upwardly to release the spring tension on the T-shaped connecting member 11. This allows the T-shaped connecting member 11 to be moved forwardly. When the T-shaped member 11 is moved forwardly sufficiently, the clamping members 4 and 5 are pivoted inwardly unitl they engage the laterally extending members 40 and 41. After the clamping members 4 and 5 engage the laterally extending members 40 and 41, the force unit 12 is moved slightly rearwardly so as to prevent inadvertent separation of the clamping members 4 and 5 and the laterally extending members 40 and 41.

With the clamping members 4 and 5 engaging the laterally extending members 40 and 41 and the force unit 12 still in a substantially vertical position, a skier may place the ski boot with the boot mounted plate 10 between the clamping members 4 and 5. Once the plate 10 is inserted between the clamping members 4 and 5, the force unit 12 is returned to its horizontal position as shown in FIG. 1. As the force unit 12 is returned to its horizontal position as shown in FIG. 1, the T-shaped member 11 is drawn rearwardly drawing the clamping members 4 and 5 into releasable engagement with the plate 10. When this is done, the ski boot 10*a* is releasably secured to the ski 2.

While an embodment of the present invention is described, it is contemplated that various changes and modifications to the embodiment may be made without departing from the spirit and scope of the present invention. For example, various spring assemblies may be connected to the clamping members 4 and 5 for automatically returning the clamping members 4 and 5 to their initial positions engaging the laterally extending members 40 and 41 of the T-shaped member 11 when the force unit 12 is raised to its vertical position. For this reason it is intended that the scope of the present invention be determined not solely by reference to the embodiment described, but rather by reference to the claims hereinafter provided and their equivalents.

What is claimed is:

1. In a ski release binding having a movable clamping member for releasably securing a ski boot to a ski rearward of the toe and forward of the rear of the heel of the ski boot, the improvement comprising means responsive to a predetermined lateral movement of said movable clamping member relative to said ski for allowing said movable clamping member to move rearwardly out of the way of lateral movement of said ski boot relative to said ski.

2. The improvement according to claim 1 wherein said binding comprises a force unit for providing a clamping force, a connecting member for connecting said force unit and said movable clamping member and said allowing means comprises means responsive to said predetermined lateral movement of said movable clamping member for disconnecting said movable clamping member and said connecting member.

3. The improvment according to claim 2 wherein said connecting member comprises a T-shaped connecting member having a laterally extending member for connecting said movable clamping member and said T-shaped connecting member and said disconnecting means comprises means for disconnecting said movable clamping member and said laterally extending member.

4. The improvement according to claim 3 wherein said T-shaped connecting member is movable longitudinally relative to said movable clamping member and said disconnecting means comprises means for disconnecting said clamping member and said laterally extending member when said T-shaped connecting member is moved a predetermined distance longitudinally relative to said movable clamping member.

5. The improvement according to claim 4 wherein said movable clamping member is pivotally mounted relative to said T-shaped connecting member for pivotally moving rearwardly when said movable clamping member is disconnected from said T-shaped connecting member.

6. The improvment according to claim 5 comprising means for returning said movable clamping member to its clamping position after a release of a ski boot therefrom.

7. The improvement according to claim 6 wherein said returning means comprises spring means.

8. The improvement according to claim 7 wherein said spring means comprises torsion spring means.

9. A ski release binding comprising a housing adapted to be mounted to a ski; first and second jaws disposed within the housing, each extending above a sole of the boot and having a protuberance shaped to engage a ski boot forward of the heel thereof and aft of the toe thereof when the jaws are in their closed position; means pivotally mounting the jaws to the housing for lateral movement of the jaws towards and away from a boot located in the binding, the housing being constructed to permit substantially unimpeded pivotal movement of the jaw until the protuberance is at a location relative to the binding which is rearward of the point where the heel of the boot is located when it is in the binding; means for generating a clamping force; means for transmitting the clamping force to the jaws when the jaws are in their closed position; and means defined by the jaws and the transmitting means permitting a disengagement of the jaws from the transmitting means after the jaws have pivotally moved a predetermined distance away from their closed position.

10. A ski release binding according to claim 9 wherein the housing substantially encapsulates portions of the jaw, including the means pivotally mounting the jaws, when the jaws are in their closed position, and wherein the housing includes an opening arranged and dimensioned to permit substantially unimpeded pivotal movement until the protuberance is at the location rearward of the heel of the boot.

11. A ski release binding according to claim 10 including spring means attached to the jaws and resiliently urging the jaws towards their closed position whereby, upon pivotal movement of the jaws to the aft location, the spring means returns the jaws to a location proximate the closed position.

12. A release binding for releasably securing a ski boot to a ski, the binding comprising: a housing adapted to be secured to the ski; first and second jaws, each jaw having a first portion disposed within the housing and a second portion disposed exteriorly of the housing and including a protuberance adapted to engage the ski boot and extending above a sole of the ski boot, the protuberance being located forward of a heel end and aft of a toe end of the boot; the housing including means permittingpivotal movement of the jaws in a plane generally parallel to the ski and laterally oriented slits through which the jaws extend so that the jaws can pivot from a closed position, in which the protuberances engage the boot, into a full release position in which the protuberances are located rearwardly of the heel of the boot; means for generating a clamping force; a link movably disposed within the housing and having a first end connected with the force generating means and a second end; and a releasable interconnecting mechanism between the link and the jaws for applying the clamping force to the jaws, the mechanism including first and second arms and cooperating first and second cutouts in the jaws and the second end of the link, the arms and the cutouts being shaped so that the clamping force urges the jaws against the boot in the binding when the jaws are in their closed position and each arm becomes disengaged from the corresponding cutout when the associated jaw moves a predetermined distance away from the closed position; whereby, upon an emergency release of the jaws from the boot, lateral movement of the boot relative to the binding and generally parallel to the ski engages the protuberance of a jaw and pivotally and substantially freely moves the jaw towards the full release position so that the protuberance cannot prevent the free release of the boot from the binding.

* * * * *